US011185902B2

(12) United States Patent
Horinouchi et al.

(10) Patent No.: US 11,185,902 B2
(45) Date of Patent: Nov. 30, 2021

(54) PLATINUM-BASED MATERIAL THIN WIRE AND METHOD FOR MANUFACTURING THE SAME

(71) Applicant: TANAKA KIKINZOKU KOGYO K.K., Tokyo (JP)

(72) Inventors: Yuki Horinouchi, Isehara (JP); Mitsuo Takada, Kanzaki-gun (JP)

(73) Assignee: TANAKA KIKINZOKU KOGYO K.K., Tokyo (JP)

( * ) Notice: Subject to any disclaimer, the term of this patent is extended or adjusted under 35 U.S.C. 154(b) by 0 days.

(21) Appl. No.: 16/763,047

(22) PCT Filed: Jan. 17, 2019

(86) PCT No.: PCT/JP2019/001204
§ 371 (c)(1),
(2) Date: May 11, 2020

(87) PCT Pub. No.: WO2019/142849
PCT Pub. Date: Jul. 25, 2019

(65) Prior Publication Data

US 2020/0384517 A1 Dec. 10, 2020

(30) Foreign Application Priority Data

Jan. 18, 2018 (JP) ..... JP2018-006120

(51) Int. Cl.
*B21C 1/02* (2006.01)
*B21C 3/02* (2006.01)
(Continued)

(52) U.S. Cl.
CPC ..... *B21C 1/02* (2013.01); *B21C 3/025* (2013.01); *C22C 5/04* (2013.01); *C23C 30/00* (2013.01);
(Continued)

(58) Field of Classification Search
CPC .. B21C 1/02; B21C 3/025; B22C 5/04; B23C 30/00; B23C 30/005; H01B 1/02; Y10T 428/2958
(Continued)

(56) References Cited

U.S. PATENT DOCUMENTS 5,129,572 A 7/1992 Keilberth et al.
5,765,418 A 6/1998 Rosenberg
(Continued)

FOREIGN PATENT DOCUMENTS

DE 10 2013 000 057 A1 7/2013
DE 102013000057 A1 * 7/2013 ..... C22F 1/14
(Continued)

OTHER PUBLICATIONS

Machine translation of jp20102725575 (Year: 2010).*
(Continued)

*Primary Examiner* — Vincent Tatesure
(74) *Attorney, Agent, or Firm* — Foley & Lardner LLP

(57) ABSTRACT

A platinum-based material element wire is coated with gold or gold alloy, and drawing-processed with a carbon-containing die. The thin wire manufactured in this manner is covered with gold or gold alloy, and the coverage of gold or gold alloy is 40% or more on an area basis. The thin wire formed of a platinum-based material is manufactured in a state of suppressing breakage in a drawing processing step, and has favorable performance in electric properties and the like. In addition, this manufacturing process is capable of efficiently manufacturing a platinum-based material thin wire while suppressing breakage when the thin wire is manufactured by drawing processing.

20 Claims, 9 Drawing Sheets

(51) Int. Cl.
*C22C 5/04* (2006.01)
*C23C 30/00* (2006.01)
*H01B 1/02* (2006.01)

(52) U.S. Cl.
CPC ..... *C23C 30/005* (2013.01); *H01B 1/02* (2013.01); *Y10T 428/2958* (2015.01)

(58) Field of Classification Search
USPC ..... 428/389
See application file for complete search history.

(56) References Cited

U.S. PATENT DOCUMENTS

| | | | |
|---|---|---|---|
| 2013/0171470 | A1 | 7/2013 | Lee et al. |
| 2019/0060968 | A1 | 2/2019 | Sumiya et al. |

FOREIGN PATENT DOCUMENTS

| | | | | |
|---|---|---|---|---|
| JP | H01-210115 | A | | 8/1989 |
| JP | H05-96321 | A | | 4/1993 |
| JP | 2005-177806 | A | | 7/2005 |
| JP | 4440743 | B2 | | 3/2010 |
| JP | 2010-275575 | A | | 12/2010 |
| JP | 2010275575 | A | * | 12/2010 |
| JP | 2014-126444 | A | | 7/2014 |
| JP | 2017-058333 | A | | 3/2017 |
| WO | WO-2017/073424 | A1 | | 5/2017 |

OTHER PUBLICATIONS

Machine translation of jp2010275575a (Year: 2010).*
Machine translation of de102013000057a1 (Year: 2013).*
International Searching Authority, "International Search Report," issued in connection with International Patent Application No. PCT/JP2019/001204, dated Mar. 5, 2019.
International Searching Authority, "Written Opinion," issued in connection with International Patent Application No. PCT/JP2019/001204, dated Mar. 5, 2019.
Extended European Search Report dated Feb. 15, 2021 for corresponding European Patent Application No. 19741625.8.

* cited by examiner

EXAMPLE (DRAWING BY 40000 m)

COMPARATIVE EXAMPLE
(DRAWING BY 5000 m)

PLATINUM-BASED MATERIAL THIN WIRE AND METHOD FOR MANUFACTURING THE SAME

RELATED APPLICATIONS

The present application claims priority under 37 U.S.C. § 371 to International Patent Application No. PCT/JP2019/001204, filed Jan. 17, 2019, which claims priority to and the benefit of Japanese Patent Application No. 2018-006120, filed on Jan. 18, 2018. The contents of these applications are hereby incorporated by reference in their entireties.

TECHNICAL FIELD

The present invention relates to a thin wire formed of platinum or platinum alloy, and a method for manufacturing the thin wire, specifically a platinum-based material thin wire having a wire diameter of 100 μm or less, and a method for manufacturing a thin wire by drawing processing, the method being capable of efficiently manufacturing a thin wire of high quality while suppressing breakage.

BACKGROUND ART

Platinum-based material thin wires formed of platinum or platinum alloy are used for sensors such as gas sensors. For example, platinum thin wires with catalytic action of platinum are used for gas detection sections of gas sensors such as hydrogen gas sensors. In addition, thin wires formed of platinum-based materials are used for main members of sensors, and other various articles such as medical equipment and devices, various electrodes, heaters and probe pins.

Metal thin wires such as platinum-based material thin wires are generally manufactured by drawing processing (wire drawing processing). Drawing processing is a processing method in which the wire diameter of an element wire prepared in advance is reduced by passing the wire through a die. In the drawing processing, passage of the wire through the die is often repeatedly performed for obtaining a set wire diameter. In drawing processing of a thin wire formed of a platinum-based material, a die formed of a hard material such as diamond is used (Patent Document 1). The reason why a hard material is applied to a die is that a platinum-based material has relatively high deformation resistance.

Wire materials to be used for various articles as described above are required to have a wide range of wire diameters, and in recent years, the demand for thin wires of 100 μm or less has increased. This is due to adaptation to size reduction of equipment such as sensors, and commercialization of coils of finely processed platinum thin wires as medical devices which have tended to be popularized in recent years.

In thinning of a wire material in drawing processing, some degree of success can be achieved by adjustment of processing conditions, selection of a lubricant and the like. However, the present inventors have found that a platinum-based material is extremely difficult to thin. That is, since a platinum-based material has large deformation resistance, the material of a die is limited, and it is difficult to suppress wear of the die even when processing conditions, so that breakage during processing or deterioration of processing accuracy tends to easily occur. In addition, in thinning of a normal metallic wire material, it is effective to use an appropriately selected lubricant in drawing processing. However, it has been found that even a lubricant has a low effect on a platinum-based material.

For the reasons described above, there is a limit to thinning of a platinum-based material, and efficient manufacturing is difficult. It is difficult to obtain a thin wire which can exhibit satisfactory properties while having a required wire diameter.

RELATED ART DOCUMENT

Patent Documents

Patent Document 1: JP 2005-177806 A

SUMMARY OF THE INVENTION

Problems to be Solved by the Invention

The present invention has been made against the backdrop of the above-mentioned situations, and an object of the present invention is to clarify the factors of difficulties in drawing processing of a platinum-based material, and provide means for eliminating the factors. The present invention clarifies a configuration of a thin wire, which is formed of a platinum-based material, is thinner than the conventional products, is of high quality, and is capable of exhibiting favorable properties. Further, the present invention provides a method for drawing-processing a thin wire formed of a platinum-based material, the method being capable of efficiently processing the thin wire while suppressing breakage. The present invention clarifies a method capable of processing a thin wire having a wire diameter of 100 μm or less.

Means for Solving the Problems

The present inventors extensively conducted studies, and first examined the details of factors of breakage and deterioration of processing accuracy in drawing processing of a platinum-based material. The present inventors considered that difficulty of thinning a platinum-based material was related to a factor other than the degrees of mechanical strength and processing resistance. This is because studies by the present inventors showed that in processing of a material having mechanical strength higher than that of platinum, the degree of wear of a die was sometimes lower than in processing of a platinum-based material. Here, the present inventors gave attention to action specific to a platinum-based material, i.e. catalytic action of platinum which is a constituent element of the platinum-based material. Platinum has been used as a source of activity (i.e. catalyst metal) of various catalysts since early times, and is known to exhibit high catalytic activity. The present inventors considered that in drawing processing of a platinum-based material, a phenomenon occurred in which under heat during processing (i.e. friction heat), the catalytic action of platinum carbonizes carbon of diamond or the like that is a constituent material of a die. The carbonization accelerates wear of the die, so that deterioration of processing accuracy and breakage easily occur.

When considering that problems in drawing processing of a platinum-based material lie in carbonization of a die by the catalytic action of the material, avoidance between the die and the element wire (i.e. platinum-based material) is beneficial as an approach for suppressing the carbonization. The present inventors conducted studies on the basis of the above considerations, and considered that when in drawing processing of a platinum-based material, an element wire was coated with another metal, it was possible to thin the wire while suppressing wear of a die.

The present inventors considered that gold (Au) was most suitable as the other metal with which the element wire was coated. The detailed reason for this will be described later, and when the element wire is coated with the other metal, and drawing-processed, the metal covers the thin wire manufactured. In this respect, gold is a metal having favorable conductivity and biocompatibility. Accordingly, as long as the metal covering the thin wire is gold, the impact on the electric properties and biocompatibility of a platinum-based material forming the thin wire can be minimized. In the present invention, gold refers to gold and gold alloys.

Of course, even though gold can be assumed to have a small impact on the thin wire, properties as a platinum-based material may be impaired depending on a covering state based on conditions such as the covering amount (i.e. coverage). Thus, the present inventors scrutinized the gold coverage on a thin wire after processing while examining the effect of suppressing breakage by coating an element wire of a platinum-based material with gold. As a result of extensive studies, it has been found that a metallic thin wire formed of a suitable platinum-based material and covered with gold at a coverage above a certain level is suitable, leading to the present invention.

That is, the present invention provides a platinum-based material thin wire having a wire diameter of 10 μm or more and 100 μm or less and formed of platinum or platinum alloy, in which the thin wire is covered with gold or gold alloy, and a coverage of the gold or gold alloy is 40% or more on an area basis.

The present invention relates to a thin wire having a wire diameter of 10 μm or more and 100 μm or less and formed of a platinum-based material. Here, the platinum-based material includes platinum (pure platinum having purity of 99.95% by mass or more) and platinum alloy. The platinum alloy is an alloy composed of platinum and at least one added element, and examples of the platinum alloy include alloys of platinum and rhodium, palladium, iridium, tungsten and nickel (platinum content: 20 to 95% by mass). Examples of the platinum alloy include alloys referred to as so-called reinforced platinum. The reinforced platinum is a dispersion-strengthened alloy in which a metal oxide is dispersed in platinum or platinum alloy. Examples of preferred dispersed particles for reinforced platinum include particles of high-melting-point valve metal oxides such as zirconium oxide and yttrium oxide, and rare earth metal oxides such as samarium oxide. The dispersed particles are preferably those having a particle size of less than 1 μm, particularly about several tens of nanometers, and the dispersion amount of the dispersed particles is preferably several percentages by mass. In various platinum-based materials described above, the content of platinum is not particularly limited.

In addition, the present invention is directed to a thin wire having a wire diameter of 10 μm or more and 100 μm or less. This is because a wire material having a diameter of more than 100 μm can be manufactured without applying the method according to the present application, and problems hardly arise in the properties of the wire material. In addition, a wire material having a wire diameter of less than 10 μm may be difficult to process even when the method according to the present invention is applied.

The present invention is intended for a wire material having a wire diameter of 10 μm or more and 100 μm or less through a drawing processing step. The wire material obtained by drawing processing has a fibrous metal structure in a material structure on a longitudinal cross-section of the wire material. Specifically, the wire material is a thin wire in which in the material structure on the longitudinal cross-section, the area ratio of crystal grains in which the aspect ratio that is a ratio of the diameter to the minor axis (i.e. diameter/minor axis) of the crystal grain is 10 or more is 50% or more.

In the thin wire according to the present invention, the gold coverage is 40% or more in terms of an area ratio. The gold coverage depends on the coating amount of gold on the element wire that is a material to be processed in a process for manufacturing a thin wire (drawing processing step). For the thin wire in which the gold coverage is less than 40%, gold coating in the process for manufacturing the thin wire may be insufficient. In this case, the surface may have minute cracks even when the thin wire has no evident breakage. Thus, for defining a preferred thin wire free from defects, the coverage is set to 40% or more. On the other hand, the upper limit of the coverage is preferably 90%. This is because an excessive coverage has no effect. The upper limit of the coverage may be controlled by precise materials of the metallic thin wire. Specifically, in the thin wire of platinum alloy such as platinum-tungsten alloy, platinum-iridium alloy or platinum-nickel alloy, the upper limit of the coverage is preferably 90%. On the other hand, regarding platinum (i.e. pure platinum), a sufficient effect is obtained when the upper limit of the coverage is about 60%.

The "covering" with gold in the present invention is not limited to a state of film-shaped gold composed of metal crystals having a width, and includes a state in which amorphous or monoatomic gold is dispersed on a thin wire.

The gold coverage in the present invention is defined by the area ratio on the surface of the thin wire. Examples of the convenient method for relatively accurately measuring an area ratio include an electrochemical measurement method. In the present invention, gold which covers a thin wire through drawing processing of an element wire may include film-shaped gold, and gold in an approximately amorphous or monoatomic state. Thus, it is suitable to apply an electrochemical measurement method. The electrochemical measurement method for determining the gold coverage in the present invention is preferably cyclic voltammetry. The cyclic voltammetry is an electrochemical measurement method in which a response current is measured at the time of sweeping an electrode potential with an appropriately sized thin wire as an electrode (i.e. working electrode). A potential-current curve (cyclic voltammogram) obtained by cyclic voltammetry measurement is analyzed, and from the amounts of electricity at a peak originating from platinum of the electrode (i.e. thin wire) and a peak originating from gold, the exposure areas of the metals are calculated. The gold coverage is calculated from the exposure areas.

The metallic thin wire according to the present invention can exhibit specific properties while having a wire diameter of 100 μm or less thanks to covering with gold in an appropriate state. In the present invention, one of properties closely related to the state of covering with gold is a cross-sectional shape of the metallic thin wire.

The carbon-containing material such as diamond, which is a constituent material of a die to be used in drawing processing of a platinum-based material as a subject of the present invention generally has high hardness, but tends to be worn dominantly at a portion having a specific crystal orientation. Thus, a die hole having a circular shape in an early stage is locally worn to turn into a polygonal shape as drawing processing proceeds. Accordingly, the cross-section of the processed metallic thin wire turns into a polygonal shape from a circular shape.

The metallic thin wire according to the present invention is manufactured through drawing processing in a state of being covered with gold as described later, and the gold suppressed wear of the die. Thus, the cross-sectional shape of the thin wire according to the present invention is made uniform. Specifically, the degree of circularity of a radial cross-section of the metallic thin wire is 0.90 or more. Here, the degree of circularity can be calculated from an area (S) and a perimeter (L) of the cross-section of the thin wire in accordance with the following equation. The upper limit of the degree of circularity in the present invention is 0.980 from a practical point of view. When the metallic thin wire according to the present invention is defined by the degree of circularity, the degree of circularity is preferably 0.92 or more.

$$\text{degree of circularity}=4\pi\times S/L^2 \quad \text{[Math. 1]}$$

Further, covering with gold in the metallic thin wire according to the present invention is related to electric properties of the wire material. The electric properties include TCR (temperature coefficient of resistance). TCR is an electric property important in wire materials to be applied to electrodes of sensors and heater coils. In the present invention, TCR is optimized by appropriate covering with gold. Specifically, a difference between TCR and $TCR^{nc}$ is within ±0.5% where $TCR^{c}$ is TCR of the thin wire of the present invention, and $TCR^{nc}$ is TCR of a thin wire which is not covered with gold. As described above, it is not to say that gold has no impact on the electric properties of a thin wire formed of a platinum-based material. In a preferred state of being covered with gold, the thin wire according to the present invention has a TCR close to $TCR^{nc}$ of the thin wire which is not covered with gold.

TCR (ppm/° C.) can be determined from the following equation on the basis of the measured values of resistance (R) at a test temperature (T° C.) and resistance ($R_a$) at a reference temperature ($T_a$° C.). In the present invention, it is preferable that the reference temperature ($T_a$° C.) is 0° C., and the test temperature (T° C.) is 100° C.

$$TCR=\{(R-R_a)/R_a\}/(T-T_a)\times 1000000 \quad \text{[Math. 2]}$$

$TCR^{nc}$ is TCR of a thin wire formed of a platinum-based material which is not covered with gold. The thin wire which is not covered with gold is a thin wire which is identical in composition to the thin wire of the present invention except for gold and which is formed of a platinum-based material with no gold. TCR measured for a platinum-based material thin wire with no gold is applied to $TCR^{nc}$. Here, it is preferable that TCR of a metallic thin wire identical in wire diameter to the metallic thin wire of the present invention is measured, and defined as $TCR^{nc}$, and it is preferable that $TCR^{nc}$ is measured at the same test temperature and reference temperature.

In addition, the thin wire of the present invention in which the gold coverage (i.e. area ratio) is in the above-described range (i.e. 40% or more and 90% or less) contains gold in an amount of 200 ppm or more and 1000 ppm or less when the amount of gold is defined on a mass basis. Gold at the above-described coverage, which is contained in the metallic thin wire, originates from a gold coating applied to an element wire in a process for manufacturing the thin wire (i.e. drawing processing step). As described later, since at this time, gold is applied in an amount 200 ppm or more and 1000 ppm or less on a mass basis, and contained in the thin wire after drawing processing as long as special treatment is not performed, the thin wire contains gold in this amount. In the present invention, the gold contained in the thin wire is broadly interpreted, is not limited to gold contained in the thin wire, and includes gold covering the thin wire as described above.

In addition, in the thin wire of the present invention, part or all of the gold may be diffused into the thin wire when the thin wire is subjected to heating in heat treatment or the like. Even such a thin wire is within the scope of the present invention as long as the thin wire contains gold covering the thin wire, and the coverage measured by an electrochemical measurement method (i.e. cyclic voltammetry) or the like is in the above-described range. Further, a thin wire which has been subjected to heat treatment and which contains gold in an amount of 200 ppm or more and 1000 ppm or less and has the above-described degree of circularity and TCR is also within the scope of the present invention.

Next, a method for manufacturing the thin wire formed of a platinum-based material according to the present invention will be described. The thin wire according to the present invention is manufactured by drawing processing. The basic steps and processing conditions in a method for drawing processing the platinum-based material are the same as in a conventional method.

That is, the method for manufacturing the platinum-based material thin wire according to the present invention includes a step of performing drawing processing by passing a platinum-based material element wire through a carbon-containing die at least once, the drawing processing including passing the element wire through the die at least once in a state of being coated with gold or gold alloy in an amount of 200 ppm or more and 1000 ppm or less based on the mass of the element wire.

In addition, the amount, 200 ppm or more and 1000 ppm or less, of gold or gold alloy with which the surface of the element wire is coated is equivalent to a thickness of 40 nm or more and 100 nm or less. Thus, the method for manufacturing the platinum-based material thin wire according to the present invention includes a step of performing drawing processing by passing a platinum-based material element wire through a carbon-containing die at least once, the drawing processing including passing the element wire through the die at least once in a state of being coated with gold or gold alloy in an amount equivalent to a thickness of 40 nm or more and 100 nm or less based on the mass of the element wire.

In the method for manufacturing the platinum-based material thin wire according to the present invention, drawing processing of the element wire formed of a platinum-based material is an essential step. The meaning of the platinum-based material is as described above. The element wire formed of a platinum-based material can be manufactured by subjecting an ingot of platinum or platinum alloy to any processing such as forging, swaging or rolling.

In the present invention, the element wire composed of a platinum-based material is coated with gold on the surface thereof, and is subjected to drawing processing. This is because direct contact between the die and the element wire is inhibited to suppress carbonization of the die by catalytic action of platinum in the element wire and associated wear of the die. The reason why gold is selected as a coating material is that gold is a chemically stable metal, and is hardly oxidized and degenerated in the process of drawing processing. Even when gold is present on the surface of a thin wire into which the element wire has been processed, there little impact on the electric properties, biocompatibility and the like of the platinum-based material.

The coating amount of gold or gold alloy on the element wire is 200 ppm or more and 1000 ppm or less based on the mass of the element wire. A coating amount of less than 200 ppm is not sufficient for preventing contact between the element wire and the die. In addition, when the coating amount is more than 1000 ppm, even gold which less adversely affects the material properties of the wire material may possibly exert a hardly negligible impact. In addition, the upper limit is set to 1000 ppm because processability is not further improved even when the coating amount is more than 1000 ppm.

This coating amount of gold or gold alloy is equivalent to a thickness of 40 nm or more and 100 nm or less. The term "equivalent to a thickness" means a thickness of the coating when the surface of the element wire is uniformly and entirely covered. The thickness equivalent coating amount can be calculated from the surface area (wire diameter) of the element wire in drawing processing, and the mass and the density of applied gold or gold alloy. In the present invention, the coating amount is equivalent to a thickness of 40 nm or more and 100 nm or less, and the meaning of the value range is the same as that of the coating amount on a mass basis.

The method for coating the element wire with gold or gold alloy is not particularly limited. A method capable of uniformly depositing a very small amount of gold on the element wire while performing control, and for example, a known method for forming a thin film can be applied, such as plating (e.g. electrolytic plating or electroless plating), sputtering, CVD or vacuum vapor deposition.

Regarding gold or gold alloy to be applied, gold is pure gold having a purity of 99% or more. The gold alloy is obtained by alloying gold with at least any one of copper, silver, platinum, palladium and nickel, and has a gold concentration of 60% by mass or more and 99% by mass or less. It is to be noted that application of pure gold is particularly preferable for coating.

In the present invention, an element wire coated with gold or gold alloy is drawing-processed at least once to form a thin wire as described above. A die which is a processing tool in the drawing processing is formed of a material containing carbon (C). As the carbon-containing die, ceramic dies, ultrahard dies and diamond dies are widely and generally used. In particular, in a region where a thin wire of 0.5 mm or less, a diamond die is used because of favorable moldability and small pull-out resistance. For the diamond die, one that has been heretofore used in drawing processing can be applied. In the diamond die, the entirety of the die is not required to be formed of diamond as long as the processing surface which contacts the element wire is formed of diamond. The diamond includes both monocrystalline diamond and sintered (polycrystalline) diamond. The hole diameter of the die can be appropriately selected according to a diameter of the element wire and an intended area reduction ratio.

The processing temperature in drawing processing is preferably 50° C. or lower. Here, the processing may be performed with a lubricant appropriately supplied to the element wire and/or the die. The main subject matter of the invention of the present application is suppression of catalytic action of platinum in a high-temperature environment under friction heat. A lubricant is useful because it has cooling action. The present inventors have confirmed that although the lubricant has cooling action, the catalytic action of platinum cannot be thoroughly suppressed regardless of how the type and the supply amount of the lubricant are adjusted. For suppression of the catalytic action of platinum, avoidance of contact between platinum and the die by coating the element wire with gold is effective, and the lubricant is merely auxiliary. As the lubricant, vegetable oils such as rapeseed oil, water-soluble oils mainly composed of surfactants, water-soluble oils given lubricity by an emulsion, and the like can be applied.

In the present invention, an element wire formed of a platinum-based material coated with gold or gold alloy is drawing-processed by passing the element wire through a die at least once. In the present invention, an element wire prepared beforehand can be coated with gold or gold alloy, and drawing-processed. Alternatively, a platinum-based material element wire with no coating can be drawing-processed in an early stage of processing, followed by coating the resulting element wire with gold or gold alloy as an intermediate step, followed by drawing-processing the element wire. When the element wire has a relatively large wire diameter, the latter process can be employed. When the element wire is repeatedly drawing-processed, annealing for removal of processing strain may be performed between the drawing processing. The annealing for removal of processing strain is generally heat treatment in the air or a nonoxidative environment at 600 or higher and 1200° C. or lower.

It is to be noted that when annealing is performed after the element wire is coated with gold or gold alloy, gold on the element wire might undergo a change such as aggregation or sublimation. Such a change might vary properties of the thin wire as a product. In addition, a platinum component might be exposed on the element wire due to aggregation, sublimation or the like of gold, leading to carbonization of the die by the catalytic action of platinum.

Thus, it is preferable that the element wire coated with gold or gold alloy is processed while annealing is avoided. That is, it is preferable to coat the element wire with gold or gold alloy at the time when the wire diameter of the element wire decreases to a certain degree.

Specifically, the coating with gold or gold alloy should be performed preferably at the time when the wire diameter of the element wire is within the range of 300 μm to 800 μm. Thus, in the present invention, it is preferable that an element wire having a wire diameter within the above-described range is prepared beforehand, coated with gold or gold alloy, and drawing-processed. In addition, for an element wire having a wire diameter exceeding the above-described range, it is preferable that first, the element wire is drawing-processed while annealing is appropriately performed, and at the time when the wire diameter reaches 300 μm or more and 800 μm or less, the element wire is coated with gold or gold alloy, and drawing-processed.

The thin wire manufactured through the above-described steps is formed of a platinum-based material coated with gold. The gold may be left without being removed. This is because in the present invention, the thin wire is coated with gold within the bounds of hardly exerting an impact as a product while thin wire processing is possible. Gold may be removed after the thin wire is manufactured. In this case, the resulting thin wire is outside the scope of the thin wire according to the present invention, but can sufficiently exhibit properties as a platinum-based material. Examples of the method for removing gold from the thin wire include physical means such as polishing, and chemical means using a chemical liquid such as aqua regia.

Advantageous Effects of the Invention

As described above, the method for drawing-processing a platinum-based material according to the present invention is capable of manufacturing a wire material of high quality by suppressing wire diameter abnormality of a processed article and breakage during processing while employing relatively simple means of coating the surface of an element wire with gold or gold alloy. This effect is based on the solution of problems specific to processing of a platinum-based material by prevention of direct contact between an element wire and a die (diamond) and suppression of the catalytic action of platinum. The wire diameter of a thin wire manufactured according to the present invention is not particularly limited. Of course, according to the object of the invention of the present application, the method is suitable for manufacturing a thin wire of 100 μm or less. According to the present invention, even a thin wire of 10 μm can be efficiently manufactured.

DESCRIPTION OF EMBODIMENTS

Embodiments of the present invention will be described below for promoting better understanding of the present invention. In the embodiments, first, processability was evaluated as a preliminary test based on factors other than coating with gold or gold alloy, such as difference in thin wire material, existence or non-existence of a lubricant and processing conditions. Thereafter, thin wire processing and product evaluation were performed as embodiments for examining usefulness of gold coating.

In the preliminary test below, the wire diameter of an element wire was set to 0.5 mm, and the wire diameter of a target thin wire was set to 0.02 mm. A diamond die made of sintered diamond (manufactured by A. L. M. T. Corp.) and having a hole diameter of 20 μm. The number of processing (i.e. the number of passages of the element wire through the die) was set to 1, and the element wire was continuously drawn. The temperature of the processing atmosphere was normal temperature, and a lubricant was used. The lubricant was supplied by pouring the lubricant to the die with a circulation pump. For evaluation of processing results, a relationship between a drawing distance and a die wear amount was evaluated. Here, the wire diameter after processing over a predetermined drawing distance was measured, and the die wear amount was calculated on the basis of the wire diameter in an early stage of processing (drawing distance: 10 m).

Preliminary test: First, element wires of a platinum-based material and a non-platinum-based material were drawing-processed, and uniqueness of die wear in processing of the platinum-based material was examined. Here, an element wire of pure platinum with a purity of 99.99% by mass and an element wire of silver alloy (Ag—Cu—Ni alloy: XP-3) manufactured by Tanaka Kikinzoku Kogyo were prepared, and drawing-processed. Here, a silver alloy element wire to be compared has a tensile strength higher by about 400 MPa than that of the pure silver wire and a Vickers hardness higher by about 200 than that of the pure platinum wire.

Figure 1:
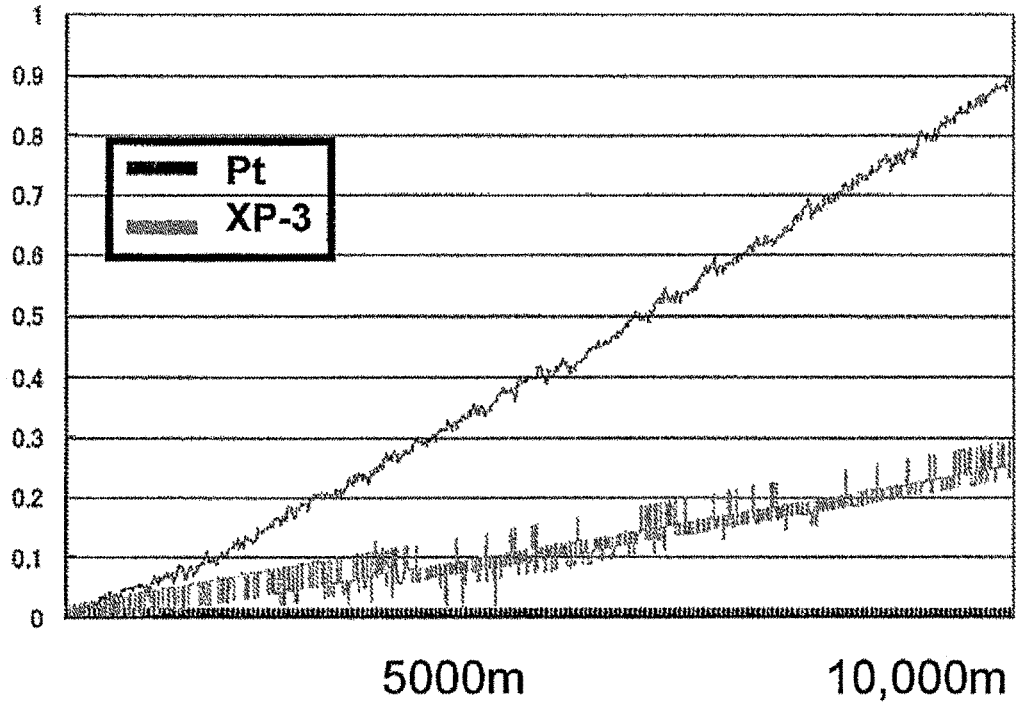
FIG. 1 illustrates a relationship between a drawing distance and a die wear amount when a platinum element wire and a silver alloy element wire are drawing-processed in a preliminary test.

FIG. 1 illustrates a relationship between a drawing distance (abscissa) and a die wear amount (ordinate) when drawing processing is performed under the conditions described above. In any of the element wires, the wear amount of the die increases as the drawing distance becomes larger. It is to be noted that the die wear amount for the platinum element wire is larger than the die wear amount for the silver alloy (AgCu alloy). The increase ratio (inclination) of the wear amount against the drawing distance is relatively mild for the silver alloy, whereas the wear amount increases at an accelerated rate for the platinum element wire. Thus, from comparison with the silver element wire having mechanical strength higher than that of the platinum element wire, it can be found that it is not possible to compare the die wear amount only on the basis of mechanical strength. From the behavior of the die wear amount for the platinum element wire, it can be presumed that action to promote wear in addition to simple mechanical damage caused only by friction between the element wire and the die is developed in the platinum-based material.

Figure 2:
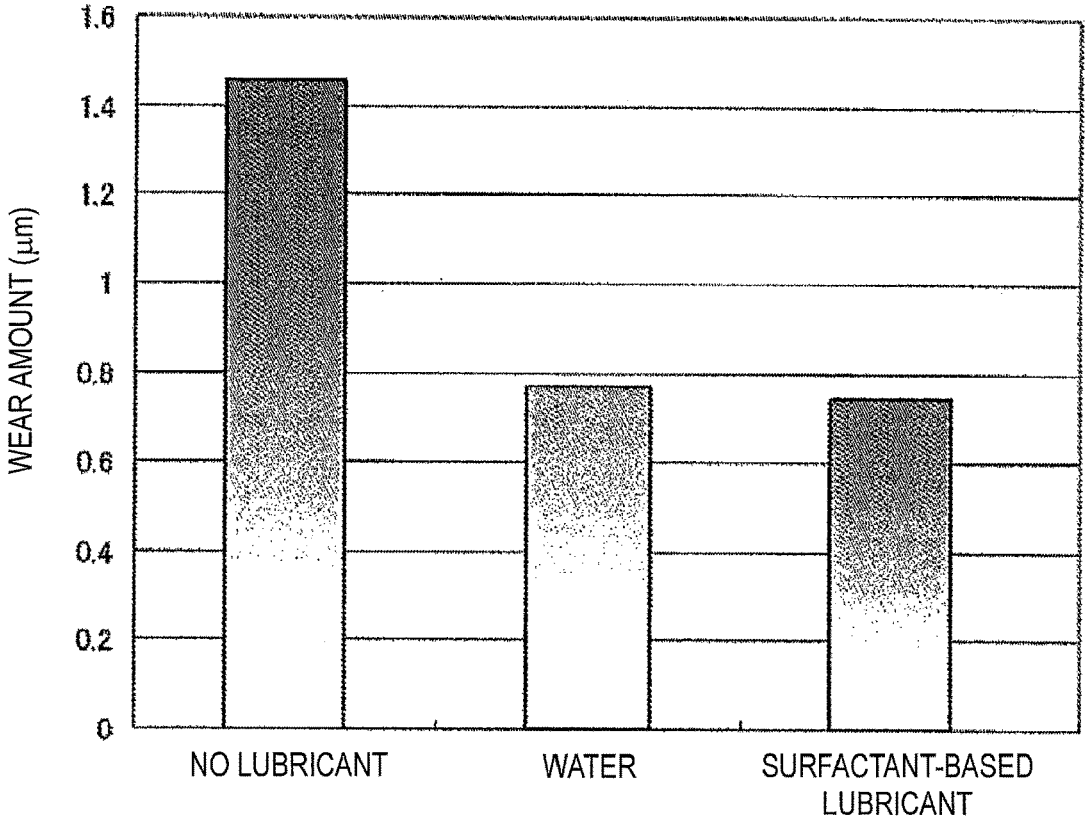
FIG. 2 illustrates a relationship between a lubricant and a die wear amount in a preliminary test.

Next, existence or non-existence of an effect of protecting the die by use of a lubricant was examined for the platinum element wire. Under the above-described processing conditions, drawing processing was performed on platinum element wires with no lubricant, with water and with a commercially available surfactant-based water-soluble oil. The die wear amount was determined from the wire diameter after the reaching of a drawing distance of 10,000 m. FIG. 2 shows the results of the comparison between these wires.

From FIG. 2, it can be said that use of a lubricant has a certain suppressive effect on die wear when compared to a case where the lubricant is not used. However, it is hard to say that wear was sufficiently suppressed by use of a lubricant because the die was worn by about 0.4 μm even when the lubricant was used. In addition, there is no significant difference between the results with water and with the surfactant-based water-soluble oil. Since water is not essentially lubricant, the die wear amount reducing effect is ascribable to cooling effect of the liquid that is water. That is, it is apparent that the die wear reducing effect of the surfactant-based water-soluble oil as a lubricant is mainly due to cooling action of the liquid. Temperature elevation cannot be thoroughly suppressed even though the lubricant has cooling action, and direct contact between the element wire and the die cannot be avoided. The results of the preliminary test show that die wear cannot be sufficiently reduced only by use of a lubricant.

Figure 3:
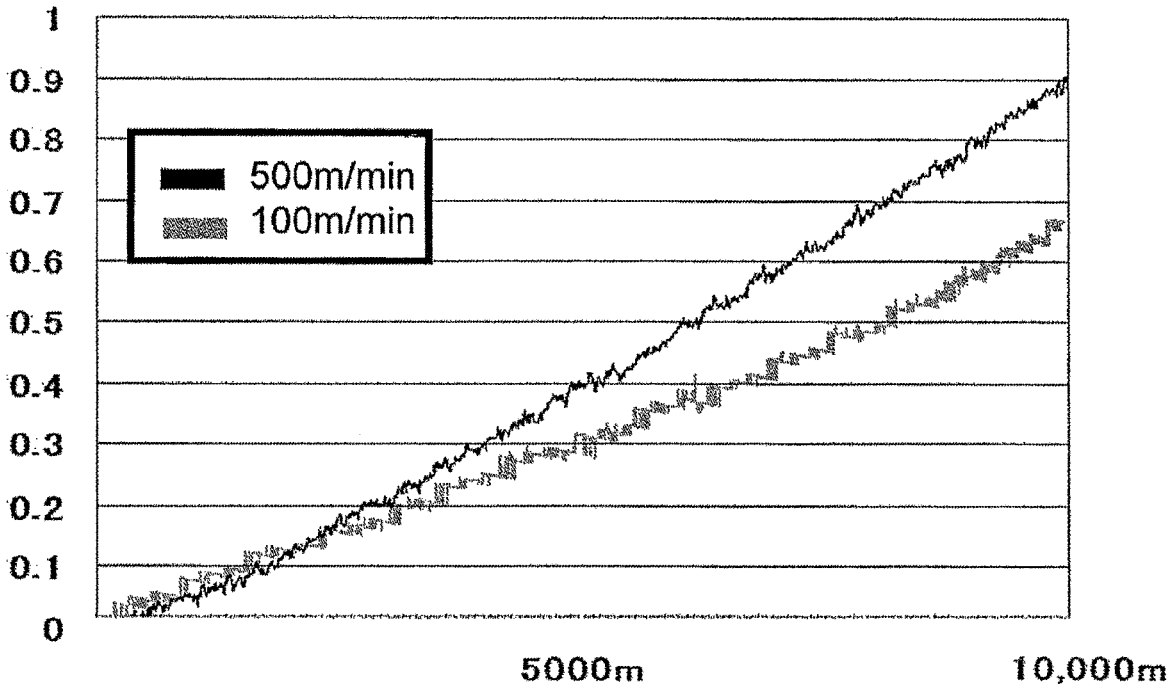
FIG. 3 illustrates a relationship between a drawing distance and a die wear amount when the processing speed is changed in a preliminary test.

Further, effects of the drawing speed on die wear was examined for the platinum element wire. FIG. 3 illustrates relationships between the drawing distance and the die wear amount when the drawing speed is set to 100 m/min and 500 m/min. By decreasing the drawing speed, die wear can be slightly suppressed in a region where the drawing distance is 5000 m or more. This is because the heat amount in processing depend on the processing speed. Of course, although die wear is suppressed, the wear amount is not low at all, and there is little difference in wear amount at a drawing distance up to about 5000 m. It may be difficult to suppress die wear by adjustment of the drawing speed.

First Embodiment

On the basis of the results of the above preliminary test, a platinum element wire coated with gold was drawing-processed. In this embodiment, a platinum element wire having a wire diameter of 500 μm (0.5 mm) was coated with gold by a plating method. The coating amount was such that 450 g of the element wire was coated with 0.22 g of gold in terms of a mass (about 488 ppm, equivalent to a thickness of 68 nm). In this embodiment, the same diamond die as in the preliminary test (die hole diameter: 20 μm (0.02 mm)) was used. In this embodiment, an attempt was made to process a thin wire whose target wire diameter was 20 μm. The temperature of the processing atmosphere was normal temperature, and a lubricant (type: surfactant-based water-soluble oil) was used. The drawing speed was set to 50 m/min. As a comparative example, an element wire which was not coated with gold was processed. Continuous drawing was performed, and the wire diameter of the manufactured thin wire was measured at predetermined intervals. The electric resistance value was measured together with the wire diameter.

Figure 4:
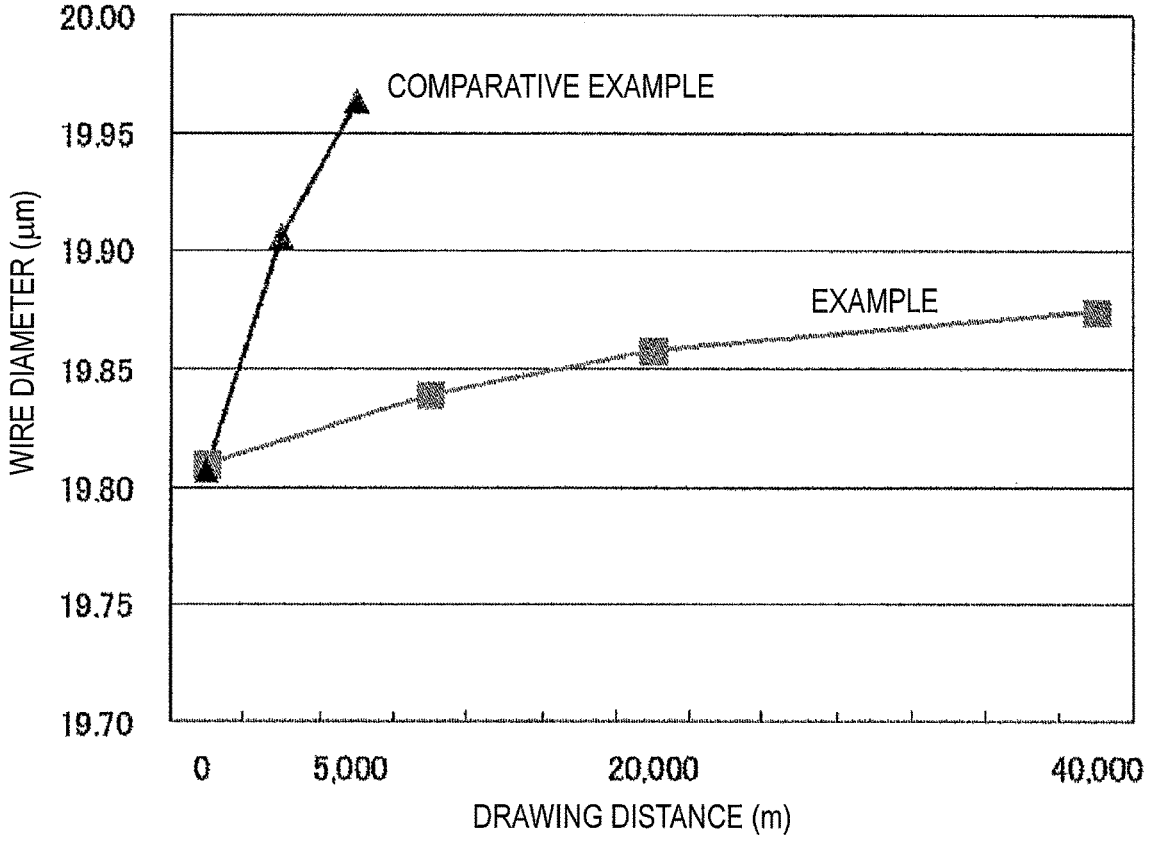
FIG. 4 illustrates a relationship between a drawing distance and a wire diameter of a thin wire when a platinum element wire is drawing-processed in each of a first embodiment and a comparative example.
Figure 5:
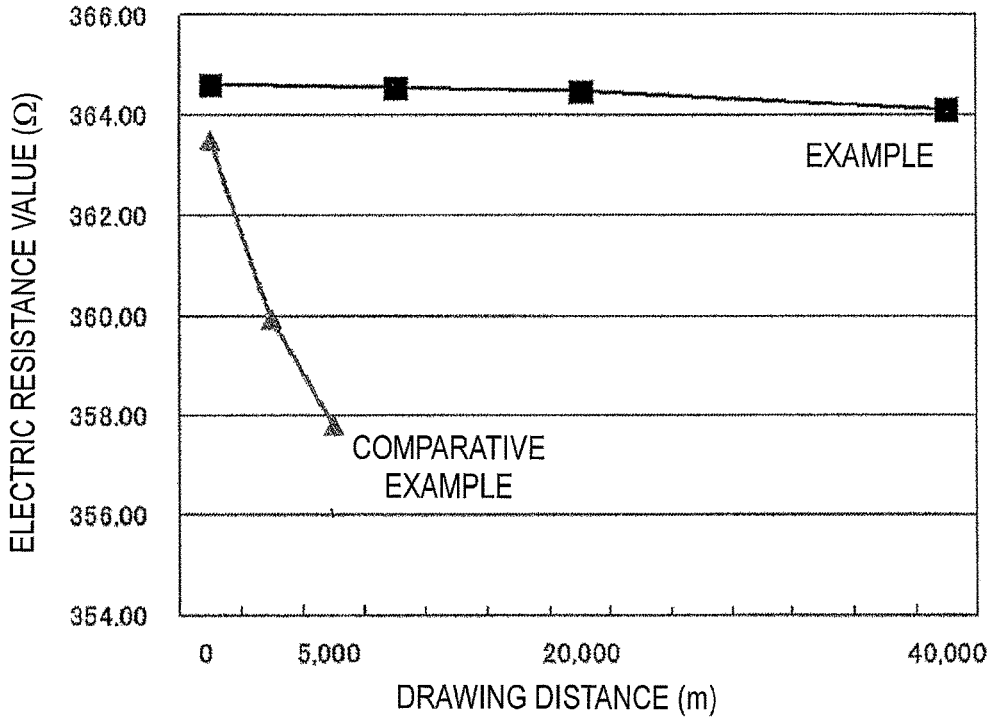
FIG. 5 illustrates a relationship between a drawing distance and an electric resistance value of the thin wire when a platinum element wire is drawing-processed in each of the first embodiment and the comparative example.

FIG. 4 illustrates a relationship between a drawing distance and a wire diameter of a thin wire after processing in each of this embodiment with gold coating and the comparative example without coating. In the comparative example, breakage occurred at a drawing distance slightly larger than 5000 m. On the other hand, in this embodiment, the drawing distance far exceeded that in the comparative example, and it was still possible to perform processing even when the drawing distance reached 40000 m. In addition, in the comparative example where gold coating was not performed, it is apparent that the rate of increase in wire diameter was large from the early stage of processing, and thus die wear progressed. In this embodiment, it is apparent that die wear was mild even at a drawing distance of 40000 m, the increase in wire diameter was less than 0.1 μm, and thus excellent processing stability was exhibited. The above tendency can also be confirmed from the results of measuring the electric resistance of the manufactured thin wire (FIG. 5). In the comparative example, the electric resistance value considerably changes (i.e. decreases) as the wire diameter increases, whereas in this embodiment, a thin wire with a small change in resistance is manufactured.

Figure 6:
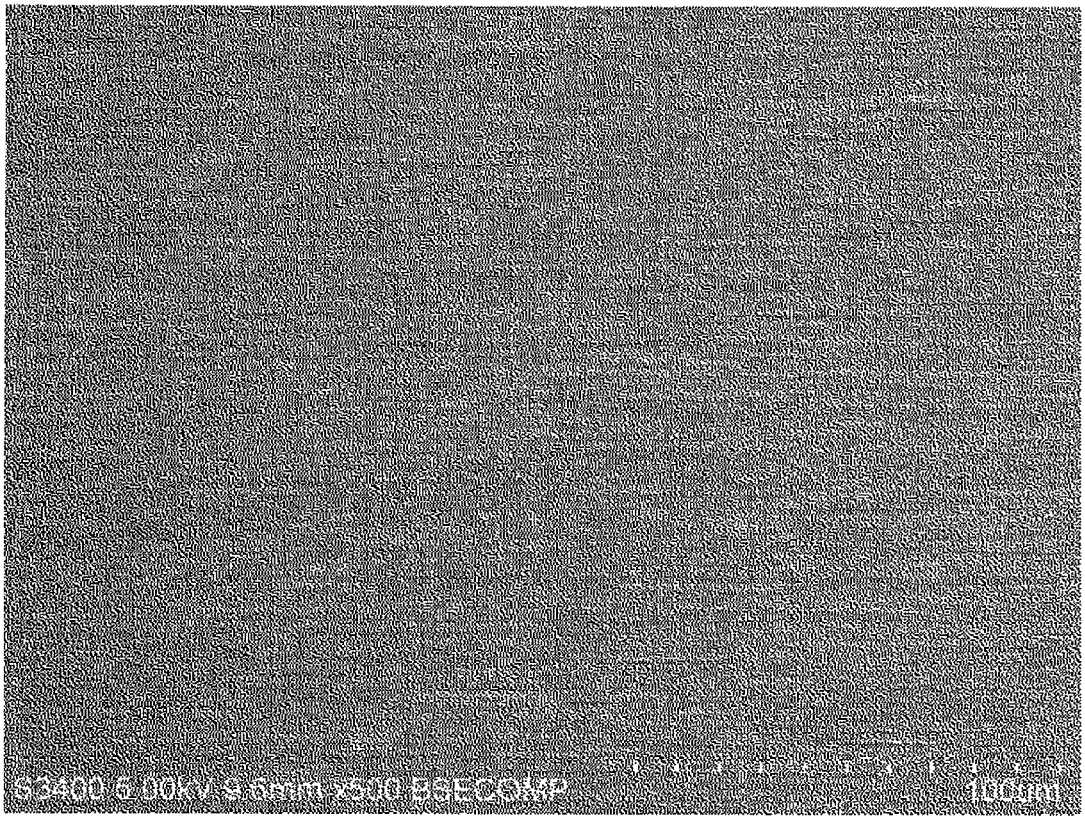
FIG. 6 illustrates the result of observing a material structure on a longitudinal cross-section of the platinum thin wire of the first embodiment.

FIG. 6 illustrates the result of observing a material structure on a longitudinal cross-section of the platinum thin wire manufactured in this embodiment. As is apparent from this photograph, a fibrous structure composed of extremely thin crystal grains is formed as a result of drawing processing. The aspect ratio of a crystal grain seeming to have the lowest aspect ratio in the visual field was measured, and the result showed that the aspect ratio was 13.0. In this embodiment, all the crystal grains (area ratio: 100%) are considered to have an aspect ratio of 10 or more.

Figure 7:
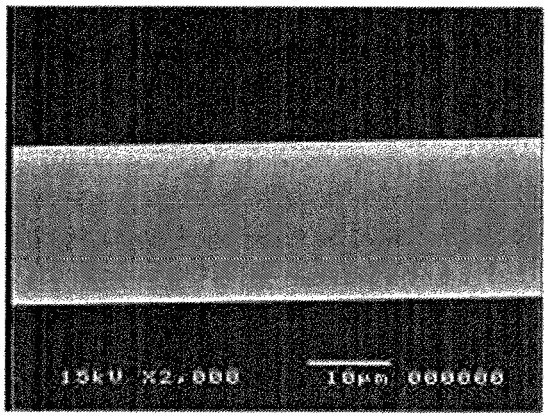
FIG. 7 is a SEM photograph showing a surface state of the platinum thin wire after processing in each of the first embodiment and the comparative example.
Figure 7:
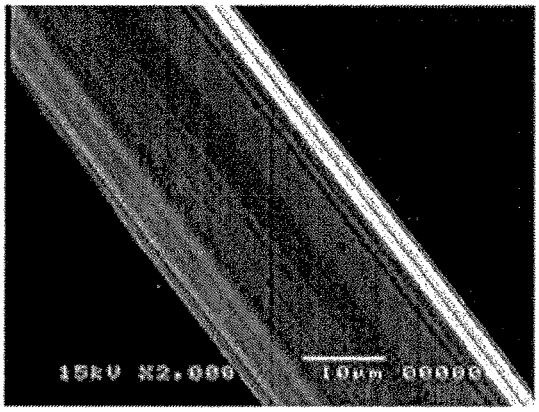

FIG. 7 illustrates a photograph showing a surface state of the thin wire of this embodiment after the wire is drawn by 40000 m, and a surface state of the thin wire of the comparative example after the wire is drawn by 5000 m. The thin wire of this embodiment is a smooth wire material having a high degree of circularity. On the other hand, in the comparative example, angles and irregularities are present on the surface, and they may result from die wear. Thus, the degree of circularity of a cross-section of the thin wire of each of this embodiment and the comparative example was measured. The result showed that the degree of circularity of the thin wire of this embodiment was 0.957. On the other hand, the degree of circularity of the thin wire of the comparative example was 0.870.

The above test results showed that by coating an element wire formed of a platinum-based material with gold, a high-quality thin wire with a small change in wire diameter was manufactured while die wear was suppressed.

Next, the gold coverage on the thin wire was measured for the platinum thin wire manufactured in this embodiment. The measurement of the gold coverage was based on cyclic voltammetry analysis with a platinum thin wire as an electrode. Measurement of a cyclic voltammogram was performed in the following manner. A working electrode, a counter electrode and a reference electrode were connected to a measuring apparatus (trade name: HZ-5000 manufactured by Hokuto Denko Corporation). The platinum thin wire manufactured in this embodiment was used for the working electrode, and a platinum electrode and a reversible hydrogen electrode (RHE) were used for the counter electrode and the reference electrode, respectively. In addition, a 0.1 M-$HClO_4$ solution was used as an electrolytic solution. In advance, the electrolytic solution was bubbled with nitrogen gas for 30 minutes. Cyclic voltammetry was performed at a sweeping rate of 10 mV/sec from 0.05 V to 1.7 V.

Figure 8:
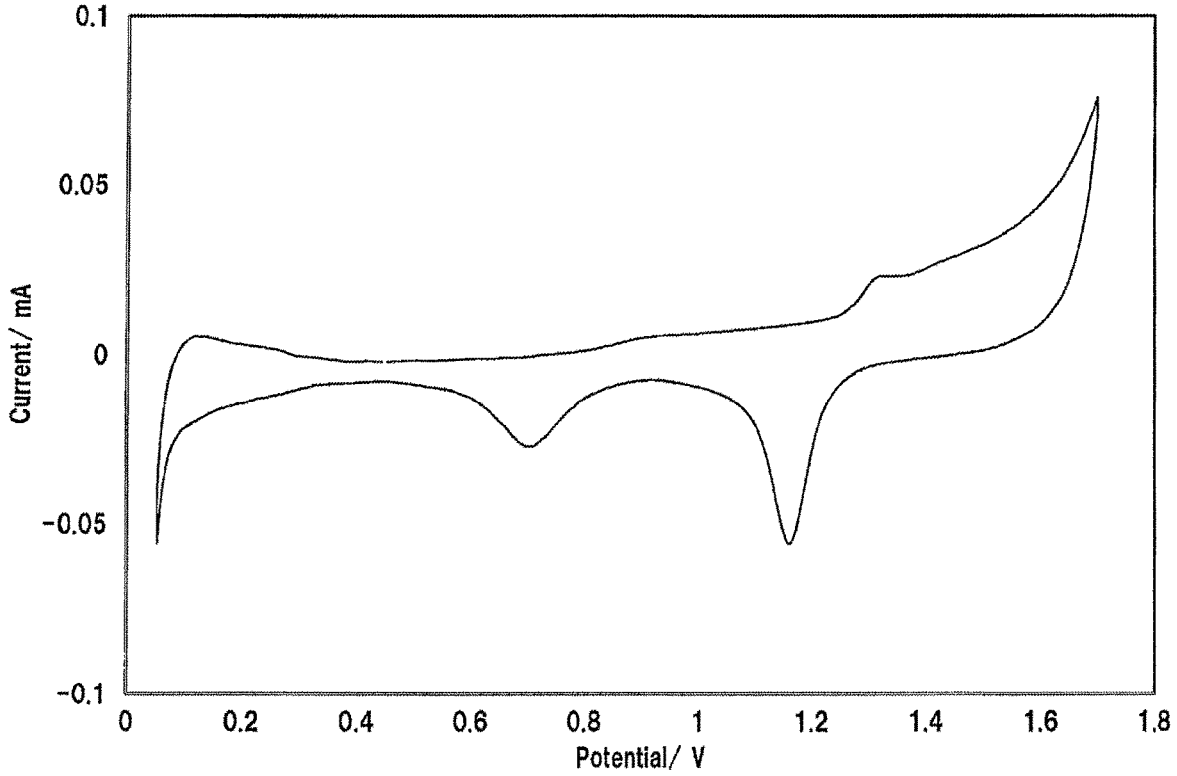
FIG. 8 illustrates a cyclic voltammogram of the platinum thin wire of the first embodiment.

FIG. 8 illustrates a cyclic voltammogram of the platinum thin wire of this embodiment. In the cyclic voltammogram of FIG. 8, the peak at about 0.65 to 0.7 V (vs. RHE) indicates formation/reduction of a platinum oxide film, and originates from platinum forming the thin wire. On the other hand, the peak at about 1.15 to 1.2 V (vs. RHE) indicates formation/reduction of an oxide film, and originates from gold covering the thin wire.

The gold coverage based on the cyclic voltammogram is calculated in the following manner. First, the amounts of electricity ($Q_{Pt}$ and $Q_{Au}$) at the peaks (platinum and gold) in the cyclic voltammogram are determined. The amount of electricity is calculated by time integration of current values at the peaks, and the calculation can be performed with general spreadsheet software or analysis software. Next, from the obtained amounts of electricity ($Q_{Pt}$ and $Q_{Au}$) and the electric capacitances for oxide layer reduction with platinum and gold ($Q_{Pt\text{-}O(red)}$: 420 μC/cm$^2$ and $Q_{Au\text{-}O(red)}$: 390 μC/cm$^2$), the areas of platinum and gold ($SA_{Pt}$ and $SA_{Au}$) are calculated. The area ratio ($SA_{Au}/(SA_{Pt}+SA_{Au})$) calculated from the respective areas is defined as a gold coverage. The gold coverage on the platinum thin wire having a diameter of 20 μm of this embodiment, based on the cyclic voltammogram of FIG. 8, was 65.6%.

Further, the temperature coefficient of resistance (TCR) was measured for the platinum thin wire manufactured in this embodiment. In this embodiment, the reference temperature and the test temperature were set 0° C. and 100° C., respectively, the resistance values at these temperatures ($R_{100}$ and $R_0$) were measured, and TCR in this embodiment with gold coating and $TCR^{nc}$ in the comparative example without gold coating were measured.

The results of measuring the TCRs showed that TCR ($TCR^c$) of the thin wire of this embodiment was 1.3857 (ppm/° C.), whereas TCR ($TCR^{nc}$) of the thin wire of the comparative example was 1.3888 (ppm/° C.). In the thin wire of this embodiment, the thin wire is covered with gold, and therefore the TCR value is slightly lower than that of the thin wire of the comparative example without gold (the thin wire of the comparative example is identical in composition to the thin wire of this embodiment except that gold is not present). However, there is an extremely small difference of −0.22% between $TCR^c$ and $TCR^{nc}$. It is considered that the platinum thin wire of this embodiment is a practically acceptable level of TCR, and can be used as such for the above-described purposes. Comparison between the resistance values in this embodiment and the comparative example at a drawing distance of about 0 m, with reference to FIG. 5, shows that there is no significant difference between the resistance values of the thin wires. Accordingly, it may be preferable that rather than the resistance value, TCR is applied for rigorous examination of the electric properties of the thin wire according to the present invention.

Second Embodiment

Here, various platinum thin wires were manufactured while the coating amount of gold on an element wire and the final hole diameter of a die were changed. The element wire to be processed is the same platinum element wire (500 μm) as in the first embodiment. In addition, the coating amount of gold was 320 ppm in terms of an element wire mass ratio and was equivalent to a thickness of 44 nm. As the die, a diamond die was used (drawing distance: 500 m) for each of the thin wired.

Regarding the manufactured thin wire, the actual wire diameter was measured, and the cyclic voltammogram was measured in the same manner as in the first embodiment to determine the gold coverage. Table 1 shows the manufacturing conditions and the measured values for the manufactured thin wires for the platinum thin wires manufactured in this embodiment.

TABLE 1

| | Manufacturing conditions | | | | Thin wire measured values | |
|---|---|---|---|---|---|---|
| | | Gold coating amount | | | | |
| No. | Pt element wire diameter | Mass ratio | Thickness equivalent | Die hole diameter | Wire diameter (actual size) | Au coverage |
| 1 | 500 μm | 320 ppm | 44 nm | 72 μm | 72 μm | 47.3% |
| 2 | | | | 46.5 μm | 47 μm | 58.5% |
| 3 | | | | 30 μm | 30 μm | 57.5% |
| 4 | | | | 11.1 μm | 11 μm | 51.7% |

As shown in Table 1, the platinum thin wires manufactured in the second embodiment each had a small deviation in wire diameter with respect to the target wire diameter (i.e. die hole diameter). In any of the thin wires, breakage did not occur during processing. The gold coverage (i.e. area ratio) on each thin wire was 40% or more.

$TCR^c$s ($R_{100}$ and $R_0$) of the thin wires of the second embodiment were measured, and the results showed that for all the thin wires, the difference was within the range of ±0.5% with respect to the value (1.3888 (ppm/° C.)) for the thin wire without gold coating in the comparative example in the first embodiment.

Third Embodiment

In this embodiment, effects of the gold coating amount on drawing processing were examined. In this regard, a platinum element wire processed to a wire diameter of 800 μm was coated with gold in an amount of 400 ppm (equivalent to a thickness of 44 nm) or 200 ppm (equivalent to a thickness of 88 nm) to manufacture a platinum thin wire. In addition, an element wire not coated with gold was processed by drawing processing. The drawing speed was set to 50 m/min. A relationship between a drawing distance and a die wear amount was examined.

Figure 9:
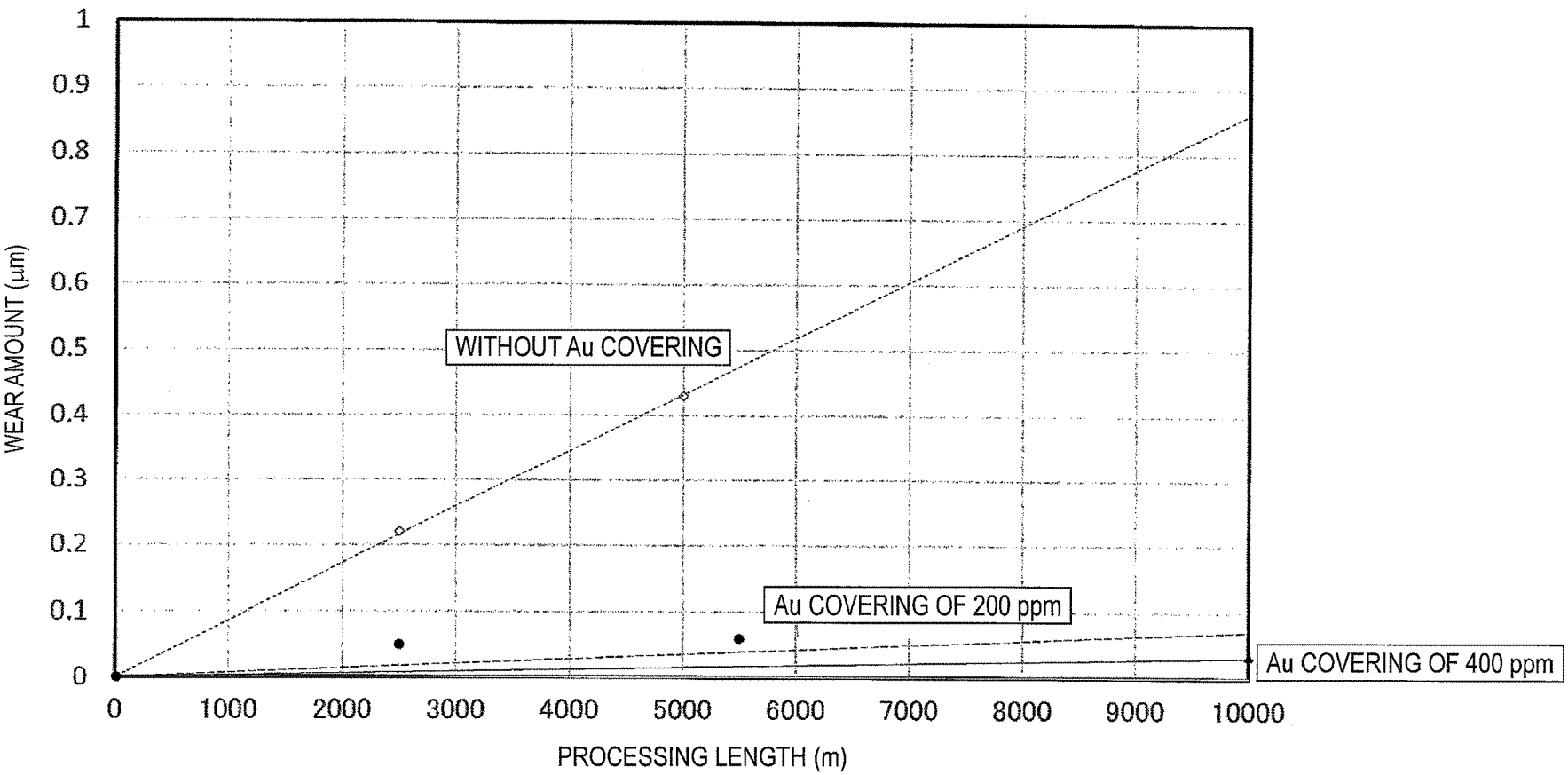
FIG. 9 illustrates a drawing distance and a die wear amount when three platinum element wires are drawing-processed in a third embodiment.

FIG. 9 shows the results of this embodiment. As described above, die wear is reduced by coating the platinum element wire with gold. In this embodiment, drawing processing was performed with the gold coating amount reduced by half, and it was shown that the die wear amount increased as the amount of gold decreased. However, even when the gold coating amount is reduced by half, wear is considerably reduced as compared to the die wear amount without gold coating.

Fourth Embodiment

In this embodiment, effects of gold coating on drawing processing of platinum alloy. An element wire having a diameter of 500 μm of platinum-tungsten alloy (Pt-8% by mass W alloy) was coated with gold in an amount of 410 ppm in terms of an element wire mass ratio (equivalent to a thickness of 57 nm) to manufacture a thin wire. The drawing speed was set to 50 m/min. A relationship between a drawing distance and a die wear amount was examined. For determining the gold coverage on the platinum alloy thin wire, the cyclic voltammogram was measured in the same manner as in the first embodiment.

Figure 10:
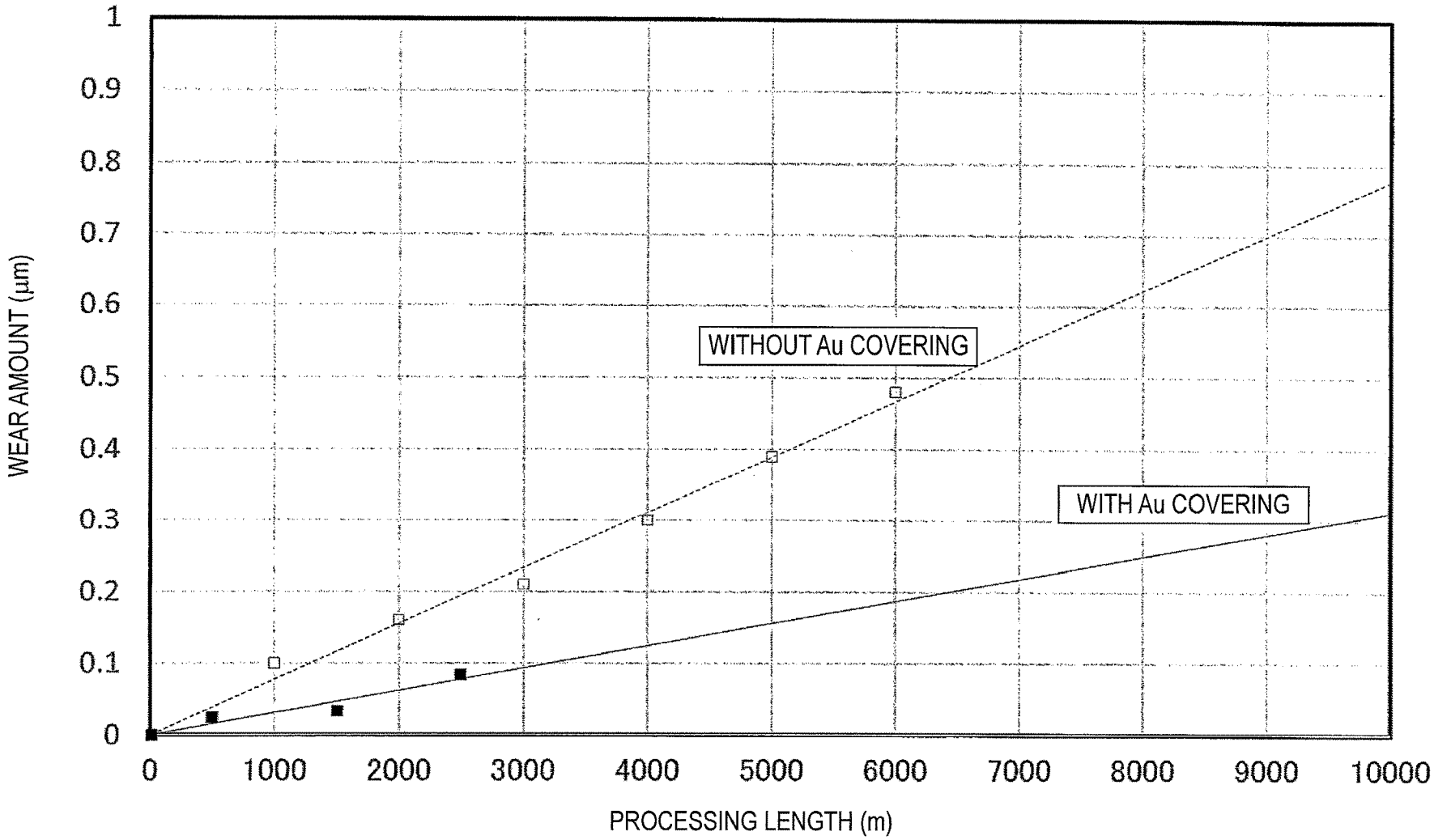
FIG. 10 illustrates a drawing distance and a die wear amount when platinum-tungsten alloy is drawing-processed in a fourth embodiment.
Figure 11:
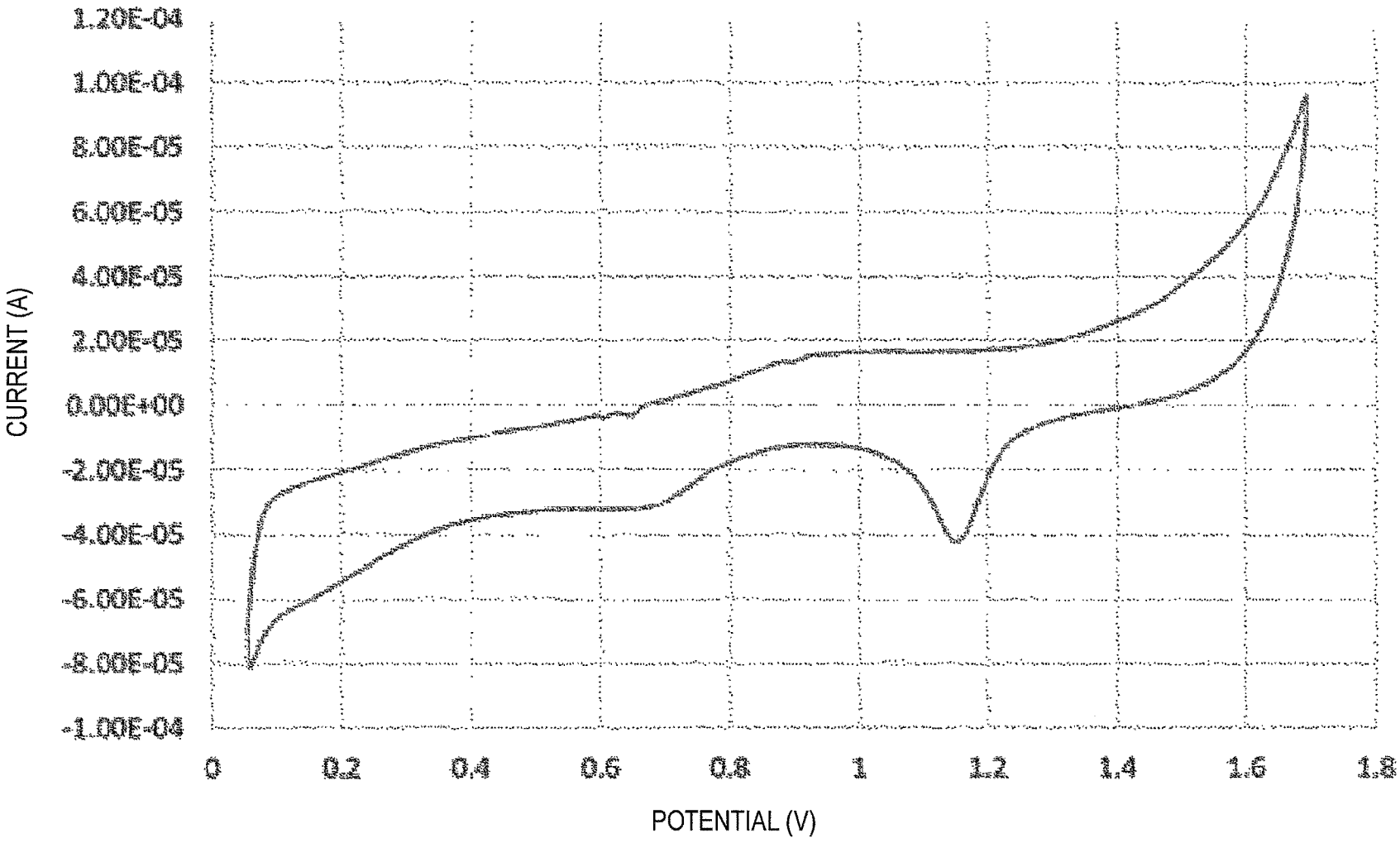
FIG. 11 illustrates a cyclic voltammogram of a platinum-tungsten alloy thin wire measured in the fourth embodiment.

FIG. 10 shows the results of the drawing distance and the die wear amount in this embodiment. The results showed that effects of gold coating were exhibited in drawing processing of not only pure platinum but also platinum alloy. FIG. 11 shows the results of measuring the cyclic voltammogram. The platinum alloy thin wire of this embodiment was coated with gold at a coverage of 73%.

Further, TCR's ($R_{100}$ and $R_0$) of the platinum-tungsten alloy thin wire of this embodiment were measured, and the results showed that the difference was within the range of ±0.5% with respect to a platinum-tungsten alloy thin wire of the same composition which was manufactured from an element wire without coating.

Fifth Embodiment

In this embodiment, platinum alloy was drawing-processed. In this regard, element wires having a diameter of 500 μm of platinum-nickel alloy (Pt-7% by mass Ni alloy) and platinum-iridium alloy (Pt-10% by mass Ir alloy) were coated with gold in an amount of 420 ppm in terms of an element wire mass ratio (equivalent to a thickness of 58 nm) to manufacture a thin wire. The drawing speed was set to 50 m/min.

Figure 12:
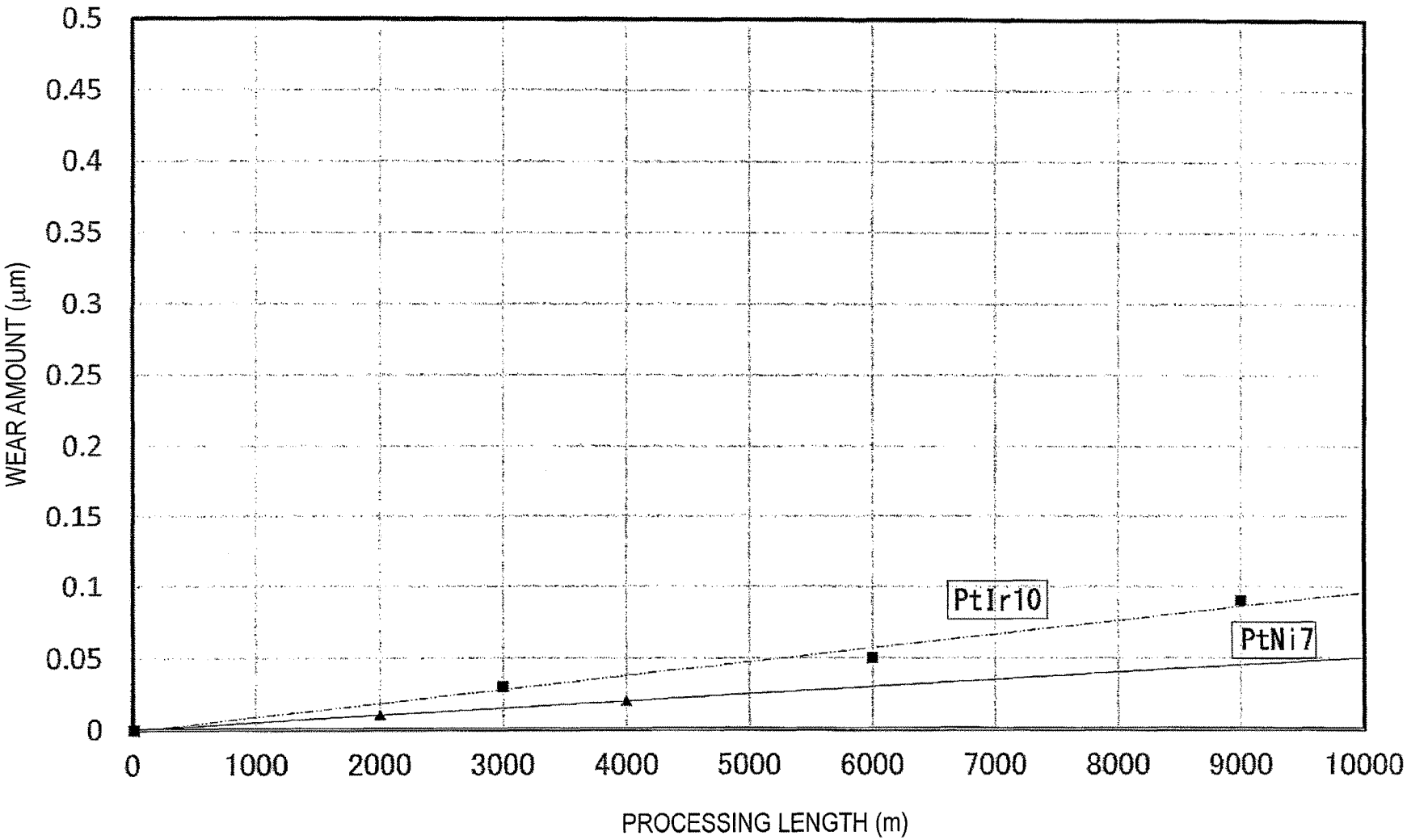
FIG. 12 illustrates a drawing distance and a die wear amount when platinum-nickel alloy and platinum-iridium alloy are drawing-processed in a fifth embodiment.
Figure 13:
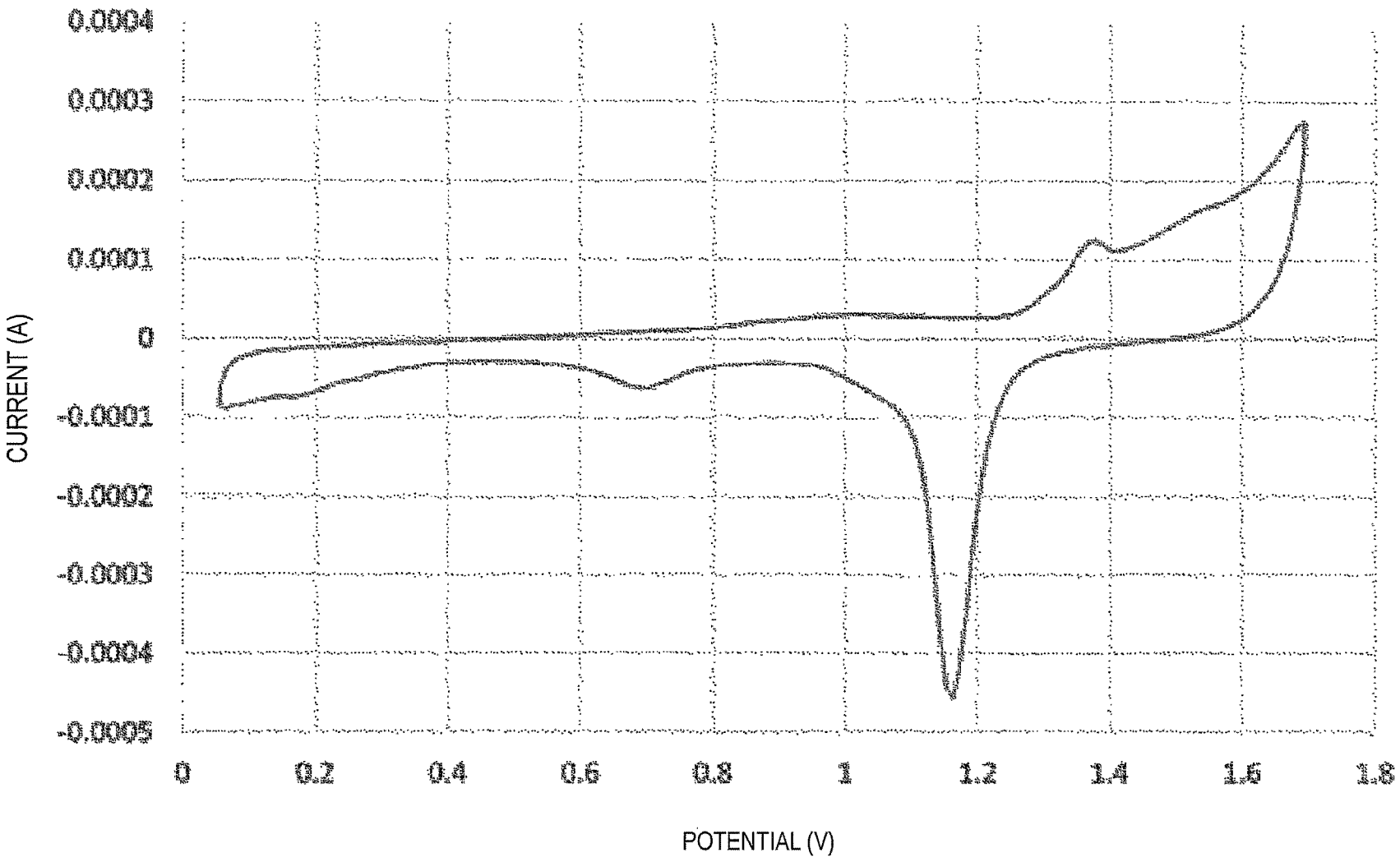
FIG. 13 illustrates a cyclic voltammogram of a platinum-nickel alloy thin wire which is measured in the fifth embodiment.

FIG. 12 shows the results of the drawing distance and the die wear amount for the platinum alloy thin wires. In drawing processing of the platinum alloy wires, the die wear amount is extremely low. For these wires, the die wear amount is expected to be less than 0.1 μm even when the drawing distance reaches 10000 m. FIG. 13 illustrates a cyclic voltammogram of a platinum-nickel alloy thin wire which is measured under the same conditions as in the first embodiment. The coverage on the platinum-nickel alloy thin wire was 90%. In this embodiment, $TCR^c$s ($R_{100}$ and $R_0$) of the thin wires were measured, and the results showed that for all the wires, the difference was within the range of ±0.5% with respect to an alloy thin wire of the same composition which was manufactured from an element wire without coating.

INDUSTRIAL APPLICABILITY

As described above, according to the present invention, a product of high quality can be manufactured while breakage during processing is suppressed in manufacturing of a platinum-based material thin wire by drawing processing. The present invention can adapt to reduction of the wire diameter of a thin wire, so that a thin wire having a wire diameter of 10 μm can be efficiently produced. The thin wire according to the present invention can be used for sensors such as hydrogen gas sensors, and other various articles such as medical equipment and devices, various electrodes, heaters and probe pins.

The invention claimed is:

1. A platinum-based material thin wire having a wire diameter of 10 μm or more and 100 μm or less and formed of platinum or platinum alloy, wherein the thin wire is covered with gold or gold alloy, a coverage of the gold or gold alloy is 40% or more on an area basis, and a degree of circularity on a radial cross-section in an arbitrary longitudinal position is 0.90 or more.

2. The thin wire according to claim 1, wherein, when $TCR^c$ is a temperature coefficient of resistance of the thin wire, and $TCR^{nc}$ is a temperature coefficient of resistance of a thin wire which is identical to the thin wire in composition except gold and which is formed of platinum or platinum alloy that does not contain gold, a difference between the $TCR^c$ and the $TCR^{nc}$ is within ±0.5%.

3. The thin wire according to claim 1, comprising gold in an amount of 200 ppm or more and 1000 ppm or less on a mass basis.

4. The thin wire according to claim 1, wherein the platinum alloy is an alloy of platinum and rhodium, palladium, iridium, tungsten or nickel, or reinforced platinum.

5. A method for manufacturing the thin wire formed of a platinum-based material according to claim 1, comprising a step of performing drawing processing by passing a platinum-based material element wire through a carbon-containing die at least once, the drawing processing including passing the element wire through the die at least once in a state of being coated with gold or gold alloy in an amount of 200 ppm or more and 1000 ppm or less based on mass of the element wire.

6. A method for manufacturing the thin wire formed of a platinum-based material according to claim 1, comprising a step of performing drawing processing by passing a platinum-based material element wire through a carbon-containing die at least once, the drawing processing including passing the element wire through the die at least once in a state of being coated with gold or gold alloy in an amount equivalent to a thickness of 40 nm or more and 100 nm or less.

7. The method for manufacturing the thin wire formed of a platinum-based material according to claim 5, wherein the carbon-containing die is one of a ceramic die, an ultrahard die and a diamond die.

8. The method for manufacturing the thin wire formed of a platinum-based material according to claim 5, wherein an element wire having a diameter of 300 μm or more and 800 μm or less is coated with gold or gold alloy, and drawing-processed.

9. The thin wire according to claim 2, comprising gold in an amount of 200 ppm or more and 1000 ppm or less on a mass basis.

10. The thin wire according to claim 2, wherein the platinum alloy is an alloy of platinum and rhodium, palladium, iridium, tungsten or nickel, or reinforced platinum.

11. The thin wire according to claim 3, wherein the platinum alloy is an alloy of platinum and rhodium, palladium, iridium, tungsten or nickel, or reinforced platinum.

12. A method for manufacturing the thin wire formed of a platinum-based material according to claim 2, comprising a step of performing drawing processing by passing a platinum-based material element wire through a carbon-containing die at least once, the drawing processing including passing the element wire through the die at least once in a state of being coated with gold or gold alloy in an amount of 200 ppm or more and 1000 ppm or less based on mass of the element wire.

13. A method for manufacturing the thin wire formed of a platinum-based material according to claim 3, comprising a step of performing drawing processing by passing a platinum-based material element wire through a carbon-containing die at least once, the drawing processing including passing the element wire through the die at least once in a state of being coated with gold or gold alloy in an amount of 200 ppm or more and 1000 ppm or less based on mass of the element wire.

14. A method for manufacturing the thin wire formed of a platinum-based material according to claim 4, comprising a step of performing drawing processing by passing a platinum-based material element wire through a carbon-containing die at least once, the drawing processing including passing the element wire through the die at least once in a state of being coated with gold or gold alloy in an amount of 200 ppm or more and 1000 ppm or less based on mass of the element wire.

15. A method for manufacturing the thin wire formed of a platinum-based material according to claim 2, comprising a step of performing drawing processing by passing a platinum-based material element wire through a carbon-containing die at least once, the drawing processing including passing the element wire through the die at least once in a state of being coated with gold or gold alloy in an amount equivalent to a thickness of 40 nm or more and 100 nm or less.

16. A method for manufacturing the thin wire formed of a platinum-based material according to claim 3, comprising a step of performing drawing processing by passing a platinum-based material element wire through a carbon-containing die at least once, the drawing processing including passing the element wire through the die at least once in a state of being coated with gold or gold alloy in an amount equivalent to a thickness of 40 nm or more and 100 nm or less.

17. A method for manufacturing the thin wire formed of a platinum-based material according to claim 4, comprising a step of performing drawing processing by passing a platinum-based material element wire through a carbon-containing die at least once, the drawing processing including passing the element wire through the die at least once in a state of being coated with gold or gold alloy in an amount equivalent to a thickness of 40 nm or more and 100 nm or less.

18. The method for manufacturing the thin wire formed of a platinum-based material according to claim 6, wherein the carbon-containing die is one of a ceramic die, an ultrahard die and a diamond die.

19. The method for manufacturing the thin wire formed of a platinum-based material according to claim 6, wherein an element wire having a diameter of 300 μm or more and 800 μm or less is coated with gold or gold alloy, and drawing-processed.

20. The method for manufacturing the thin wire formed of a platinum-based material according to claim 7, wherein an element wire having a diameter of 300 μm or more and 800 μm or less is coated with gold or gold alloy, and drawing-processed.

* * * * *